US009595750B2

(12) United States Patent
Leonard et al.

(10) Patent No.: US 9,595,750 B2
(45) **Date of Patent: *Mar. 14, 2017**

(54) CARBON FIBER-BASED CHASSIS COMPONENTS FOR PORTABLE INFORMATION HANDLING SYSTEMS

(71) Applicants: Brian H. Leonard, Austin, TX (US); David J. Hernandez, Round Rock, TX (US); Chuan Beng Sim, Shanghai (CN)

(72) Inventors: Brian H. Leonard, Austin, TX (US); David J. Hernandez, Round Rock, TX (US); Chuan Beng Sim, Shanghai (CN)

(73) Assignee: Dell Products L.P., Round Rock, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/076,023

(22) Filed: Mar. 21, 2016

(65) Prior Publication Data

US 2016/0204498 A1 Jul. 14, 2016

Related U.S. Application Data

(63) Continuation of application No. 14/169,376, filed on Jan. 31, 2014, now Pat. No. 9,318,791.

(51) Int. Cl.

| | |
|---|---|
| ***H01Q 1/24*** | (2006.01) |
| ***H01Q 1/22*** | (2006.01) |
| ***H01Q 9/30*** | (2006.01) |

(52) U.S. Cl.

CPC ..... *H01Q 1/2266* (2013.01); *H01Q 9/30* (2013.01); *Y10T 29/49016* (2015.01)

(58) Field of Classification Search

CPC ..... H01Q 1/2266; H01Q 9/30
USPC ..... 343/700, 702; 361/679.01
See application file for complete search history.

(56) References Cited

U.S. PATENT DOCUMENTS

| | | | | |
|---|---|---|---|---|
| 6,552,686 | B2 | 4/2003 | Ollikainen et al. | |
| 8,269,675 | B2 | 9/2012 | Kough et al. | |
| 8,325,094 | B2 | 12/2012 | Vazquez et al. | |
| 8,410,984 | B2 | 4/2013 | Sato et al. | |
| 8,441,783 | B2 | 5/2013 | Tanaka et al. | |
| 8,773,310 | B2 | 7/2014 | Shiu et al. | |
| 2004/0113850 | A1 * | 6/2004 | Olsen | H01Q 1/088 343/702 |
| 2011/0006953 | A1 | 1/2011 | Chiang et al. | |

(Continued)

*Primary Examiner* — Peguy Jean Pierre
(74) *Attorney, Agent, or Firm* — Egan Peterman Enders Huston

(57) ABSTRACT

A chassis component of an information handling system may include a chassis main lid component constructed of carbon fiber composite material that supports a lid chassis antenna housing that includes an internal antenna cavity defined therein to create an antenna window for the system. The carbon fiber composite material may be attached to the chassis antenna housing by an interlocking rib that provides sufficient joint strength to allow for a substantially larger and extended chassis antenna housing with larger antenna window that may be spaced further away from the carbon fiber composite material of the chassis main lid component than would otherwise be possible for the same form factor size so as to minimize or substantially eliminate shielding or blocking of wireless signals by the carbon fiber composite material lid component that would result in reduced system wireless performance.

21 Claims, 8 Drawing Sheets

(56) References Cited

U.S. PATENT DOCUMENTS

| | | | |
|---|---|---|---|
| 2011/0050509 | A1 | 3/2011 | Vazquez et al. |
| 2013/0076573 | A1 | 3/2013 | Rappoport et al. |
| 2013/0300618 | A1 | 11/2013 | Yarga et al. |
| 2015/0222007 | A1 | 8/2015 | Leonard et al. |

* cited by examiner

CARBON FIBER-BASED CHASSIS COMPONENTS FOR PORTABLE INFORMATION HANDLING SYSTEMS

This application is a continuation of pending U.S. patent application Ser. No. 14/169,376, filed on Jan. 31, 2014 and entitled "Carbon Fiber-Based Chassis Components For Portable Information Handling Systems", the entire disclosure of which is incorporated herein by reference.

FIELD OF THE INVENTION

This invention relates generally to information handling systems, and more particularly to carbon fiber-based chassis components for portable information handling systems.

BACKGROUND OF THE INVENTION

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Designs for portable information handling systems such as laptop and notebook computers have become increasingly smaller, thin and lightweight. Examples of smaller portable information handling systems include subnotebook designs such those meeting the Intel Ultrabook specification. The move to ultrabook products and other smaller systems generally requires the use of lighter materials, thinner materials and chassis designs that do not impact product size or performance. Carbon fiber composite materials have been used as chassis materials for portable information handling systems since their increased strength allows for thinner chassis parts, such as thinner portable computer lids, than is possible with conventional plastic resin chassis materials. However, since carbon fiber composite materials shield wireless radio frequency (RF) signals, sufficient spacing must be provided between the composite fiber chassis materials and an antenna element of the system. This generally requires a non-electrically conductive plastic antenna housing to be attached to a carbon fiber composite part, e.g., such as along the top edge of a carbon fiber composite lid chassis component, for housing an antenna element.

However, one limitation to allowing the utilization of carbon fiber composite parts attached to a secondary resin (plastic) can be difficult to implement without increasing the product size and weight, and/or decreasing the wireless performance, of such smaller portable information handling systems. This is because, for reasons of strength, conventional methods for attaching carbon fiber composite parts to a secondary resin (such as plastic) require part and joint thicknesses that are greater than would otherwise be required for either the carbon fiber composite part or secondary resin part alone. For example, in the past, carbon fiber composite parts have been attached to a secondary resin using a butt joint method. Other conventional techniques have utilized an overlap joint to secure the carbon fiber composite part and secondary resin together. To meet joint strength requirements, the joints of these conventional attachment methodologies result in a thicker and/or heavier overall product than would otherwise be required.

SUMMARY OF THE INVENTION

Disclosed herein are carbon fiber composite chassis components and configurations for portable information handling systems such as laptop, notebook, and subnotebook systems such as netbook and ultrabook computers. Advantageously, in one embodiment the disclosed carbon fiber-based chassis components (e.g., such as notebook or ultrabook lid component) may be attached to a secondary resin and implemented in a manner that results in a lighter system chassis without substantially growing the size of the system or affecting overall system size, and without substantially affecting antenna performance, e.g., to provide a portable information handling system that is thin, lightweight and durable.

In one exemplary embodiment, a chassis component of an information handling system (e.g., such as a lid of a portable information handling system) may include a chassis main lid component constructed of at least partially or fully radio frequency (RF)-shielding carbon fiber composite material that supports a chassis antenna housing (e.g., lid chassis antenna housing) that includes an internal antenna cavity defined therein to create an antenna window for the system. The antenna housing may be a shell or other structure constructed of a substantially non-electrically conductive material (e.g., such as a non-electrically conductive plastic resin) that is substantially non-shielding to radio frequency (RF) signals, and may be configured to receive and surround a radio frequency (RF) antenna element, for example, such as an antenna element configured for transmitting and receiving 802.11a/b/g/n wireless LAN signals (e.g., communicating at a frequency from about 2.4 GHz to about 5.9 GHz) or other wireless communication signals such as Bluetooth signals (e.g., communicating at a frequency from about 2.402 GHz to about 2.480 GHz), cellular signals like 3G or LTE (e.g., communicating at a frequency from about 700 MHz to about 3.6 GHz), etc.

Thus, in one exemplary embodiment, an antenna housing may be substantially non-shielding to RF signals in any of at least the aforescribed frequency ranges or in a total range of from about 700 MHz to about 5.9 GHz, while the lid chassis antenna housing is at least partially or fully shielding of RF signals in any of at least the aforescribed frequency ranges or aforescribed total frequency range. It will be understood, however, that the foregoing frequency ranges are exemplary only.

Advantageously, the carbon fiber composite material may be attached to the chassis antenna housing by an interlocking rib that provides sufficient joint strength to allow for a substantially larger and extended chassis antenna housing with larger antenna window to be supported by a lid main chassis component than would otherwise be possible for a conventional joint (e.g., butt or overlap joint) of the same thickness. Such a larger antenna housing allows an antenna element to be spaced further away from the carbon fiber composite material of the chassis main lid component than would otherwise be possible for the same form factor size so as to minimize or substantially eliminate shielding or blocking of wireless signals by the carbon fiber composite material lid component that would result in reduced system wireless performance. This in turn allows for efficient product packaging and smaller product designs.

In one respect, disclosed herein is a portable information handling system, including: a chassis antenna housing having an antenna cavity defined therein between a first end and a second end of the chassis antenna housing, the chassis antenna housing including a first elongated rib formed on the first end of the chassis antenna housing; and a separate main chassis component including carbon fiber composite material, the main chassis component including a second elongated rib formed on a first end of the main chassis component. The first elongated rib and second elongated rib may be coupled together in interlocking mated relationship to support the chassis antenna housing from the first end of the main chassis component in extended cantilevered relationship to the main chassis component.

In another respect, disclosed herein is a portable information handling system, including: a main chassis component including carbon fiber composite material and having a first end and a second end; and a separate bottom component coupled to the second end of the main chassis component. The main chassis component may have a first thickness; a portion of a terminal edge of the second end of the main chassis component may have a second wall thickness that is less than the first thickness and is coupled to a mating layer segment of the bottom component with the mating layer segment of the bottom component oriented in a direction parallel to a major plane of the main chassis component; and the combined coupled thickness of the mating layer segment of the bottom component and the second thickness of the terminal portion of the main chassis component may be substantially equal to and aligned with the first thickness of the main chassis component.

In another respect, disclosed herein is a method of supporting an antenna housing for a portable information handling system, including: providing a chassis antenna housing having an antenna cavity defined therein between a first end and a second end of the chassis antenna housing, the chassis antenna housing including a first elongated rib formed on the first end of the chassis antenna housing; providing a separate main chassis component including carbon fiber composite material, the main chassis component including a second elongated rib formed on a first end of the main chassis component; and coupling the first elongated rib and second elongated rib together in interlocking mated relationship to support the chassis antenna housing from the first end of the main chassis component in extended cantilevered relationship to the main chassis component.

DESCRIPTION OF ILLUSTRATIVE EMBODIMENTS

Figure 1:
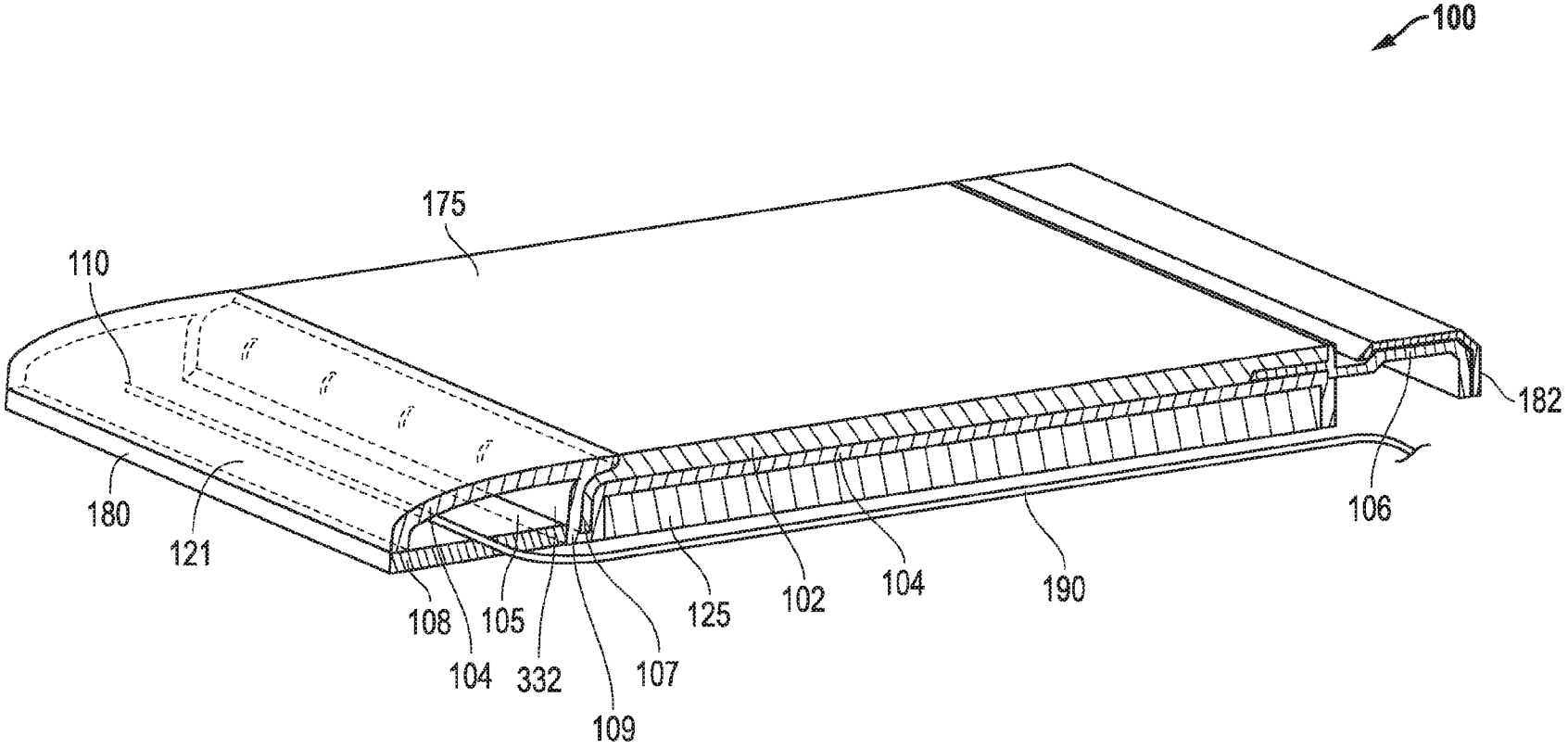
FIG. 1 illustrates a perspective cut-away view of a portable information handling system lid according to one exemplary embodiment of the disclosed systems and methods.

FIG. 1 illustrates a perspective cut-away view of a lid 100 of a portable information handling system (e.g., such as netbook computer, notebook computer, ultrabook computer, etc.) as it may be configured according to one exemplary embodiment with a lid main chassis component 102 and an lid chassis antenna housing 121. However, although described in relation to a lid embodiment, it will be understood that in other embodiments a main chassis component and antenna housing may be similarly provided for other configurations of portable information handling systems, such as for non-lid chassis components of a tablet computer, smart phone, etc.

Figure 5:
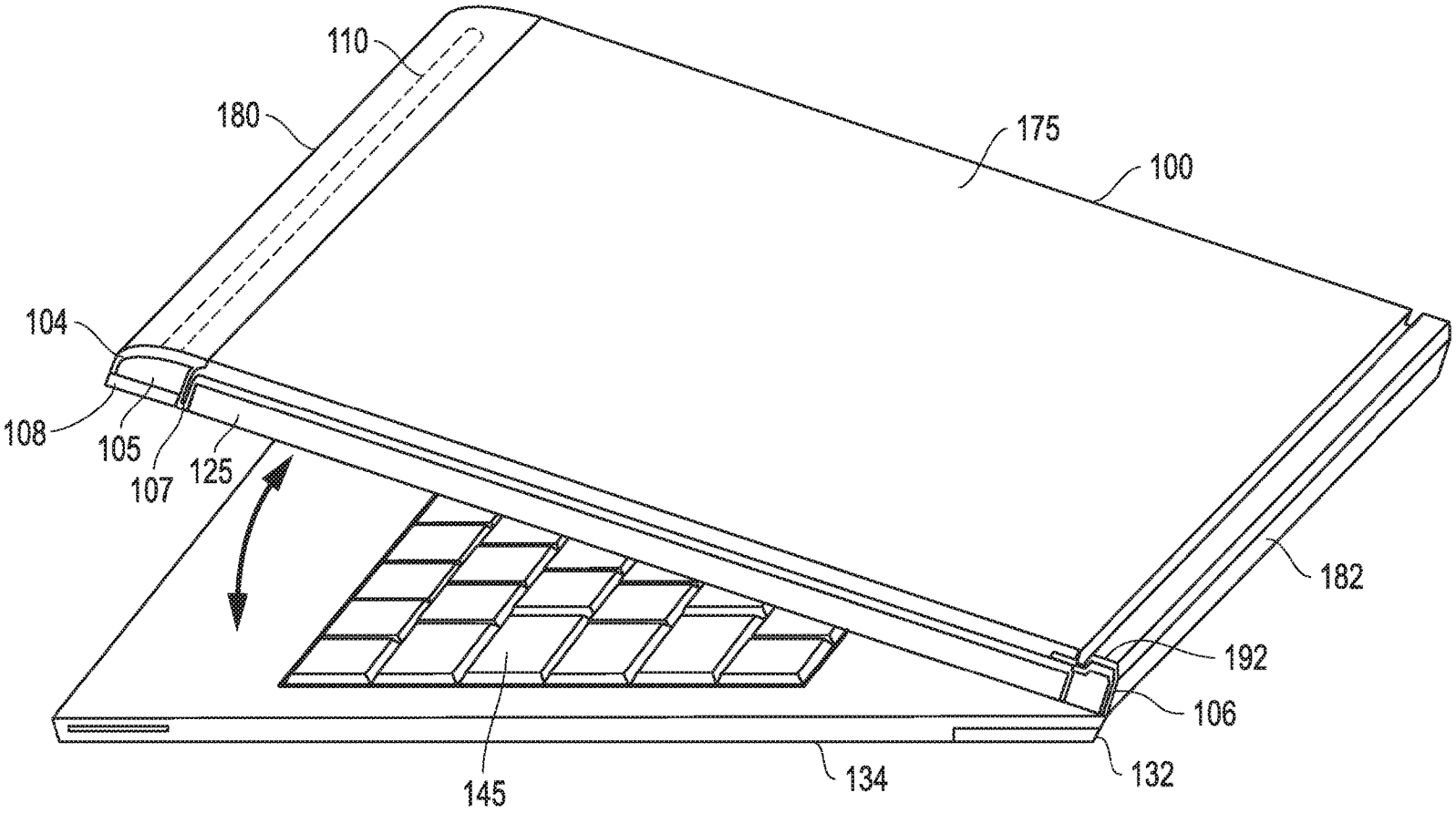
FIG. 5 illustrates a perspective cut-away view of a portable information handling system according to one exemplary embodiment of the disclosed systems and methods.

In this exemplary embodiment, lid 100 includes a top end 180 and a bottom end 182, the latter of which is configured to be hingeably coupled to a chassis base component at a hinge line as further illustrated in FIG. 5. As further shown in FIG. 1, an internal antenna cavity 105 is defined within a lid chassis antenna housing 121 across the width, and adjacent the top end 180, of the lid 100 so as to create an antenna window for the system. The antenna cavity 105 is configured as shown to receive a linear antenna element 110 that extends across the width of the lid 100 within the cavity 105, although antenna cavity 105 may be configured to receive any other type, length, and/or configuration of antenna therein. The linear antenna element 110 may be coupled by antenna lead/s 190 extending along one or more side edges of lid 100 to wireless transceiver circuitry within a chassis base component of the information handling system, and may be configured for transmitting and receiving wireless communication signals, e.g., 802.11a/b/g/n wireless LAN signals or other types of wireless communication signals such as Bluetooth signals, cellular signals such as 3G or LTE, etc. As further shown, lid 100 includes a display element 125 (e.g., LCD or LED display) that is mounted within lid 100.

Still referring to the exemplary embodiment FIG. 1, lid 100 includes a lid main chassis component 102 that supports lid chassis antenna housing 121 from one end in extended cantilevered relationship to lid main chassis component 102. Lid chassis component may be constructed of a carbon fiber composite material such as described elsewhere herein. As such, lid main chassis component 102 may be electrically conductive and therefore partially or fully shielding and non-transmissive to wireless (e.g., RF) transmissions from and to and antenna element such as antenna element 110. In contrast, lid chassis antenna housing 121 may be constructed of substantially non-electrically conductive material segments 104 and 108 (e.g., such as segments of non-electrically conductive plastic resin) that is substantially non-shielding and therefore transmissive to wireless (e.g., RF) transmissions from and to antenna element 110. Moreover, in one exemplary embodiment, lid chassis antenna housing 121 may be sufficiently large to allow placement of antenna element 110 within antenna cavity 105 so as to provide a standoff or distance "A" between antenna element 110 and the first end (e.g., top end) 332 of lid main chassis component 102 (see FIG. 2A) that is great enough to minimize or substantially prevent any shielding of wireless (e.g., RF) transmissions from and to and antenna element 110. At the same time, provision of an elongated interlocking rib 107 on the first end 332 of carbon fiber composite lid main chassis component 102 is used to attach non-conductive material 104 of lid chassis antenna housing 121 to carbon fiber composite material 102 with a joint that is sufficiently strong such that it is required to be no thicker than either of non-conductive material 104 or carbon fiber composite material 102 as shown in FIG. 2A.

Carbon fiber composite lid main chassis component 102 may be any suitable layer or combination of layers that include carbon fiber material, e.g., combined with one or more other materials such as binding resins and/or other types of composite materials. For example, carbon fiber composite lid main chassis component 102 may be a combination of carbon fiber material (e.g., fabric of woven carbon fiber filaments) with a resin binding matrix (e.g., such as thermoset or thermoplastic polymer resins) or other binding polymer that is suitable for forming a carbon fiber reinforced polymer material. Specific examples of suitable binding polymers include epoxy resin, although other binding polymers such as polyester, nylon, vinyl ester, etc. may be employed. Examples of configurations of carbon fiber-based composite materials that may be employed to create the disclosed chassis parts include, but are not limited to, composite stack ups of carbon fiber/foam core/carbon fiber (C/CF/C), carbon fiber/fiberglass/fiberglass/carbon fiber (C/G/G/C), carbon fiber/fiberglass/carbon fiber (C/G/C), etc. A resin such as previously described may be employed to bind together the individual components of such composite stack ups.

Substantially non-electrically conductive material segments (e.g., such as segments 104, 106 and 108 illustrated herein) may in one embodiment have no separate carbon or carbon-based material content (e.g., having no carbon fill material content and no carbon fiber material content). In this regard, these substantially non-electrically conductive material segments may be constructed in one embodiment of any suitable substantially non-electrically conductive material/s, such as plastics or plastic resins having no separate carbon or carbon-based material content (e.g., plastics or plastic resins having no carbon fill material content and no carbon fiber material content). Examples of such suitable materials include plastics and plastic resins, glass filled plastics and glass filled plastic resins, etc. During manufacture, such substantially non-electrically conductive material/s may be adhered to carbon fiber composite lid main chassis component 102 by, for example, bonding (adhesive), molding or injection molding.

Figure 2A:
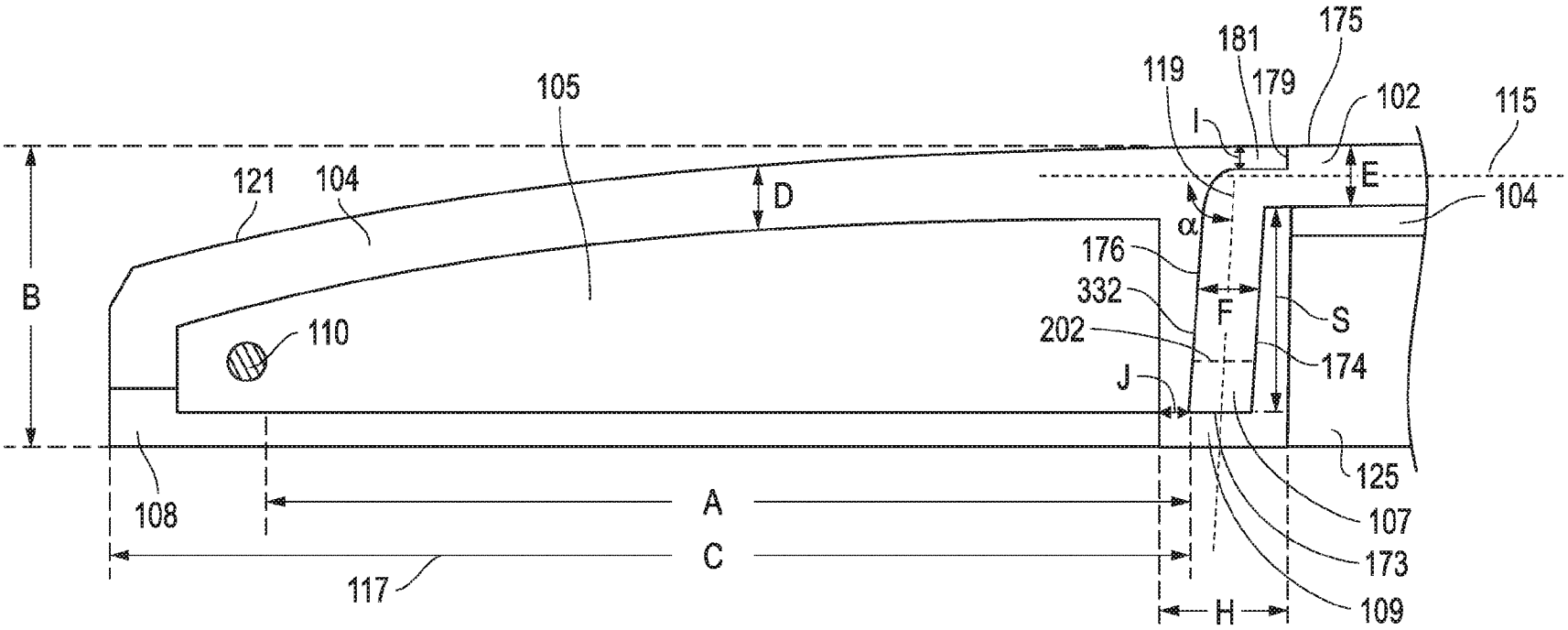
FIG. 2A illustrates a partial side cross sectional view of a portable information handling system lid according to one exemplary embodiment of the disclosed systems and methods.

As shown in in further detail in cross section of FIG. 2A, interlocking rib (e.g., formed edge) 107 extends side to side across the top of lid main chassis component 102 and at an optional angle relative to the major plane 115 of lid main chassis component 102 such that it is received and trapped in an interlocking manner within a corresponding and complementary outer support rib 109 of non-electrically conductive material segment 104. This allows the backside of surface 175 of lid 100 to be provided with a smooth profile and smooth transition between main chassis component 102 and lid chassis antenna housing 121, and also allows the overall thickness "B" of lid 100 (see FIG. 2A) to be dictated only by the thickness of lid main chassis component 102 that is required to provide sufficient overall end to end strength to lid 100, e.g., for both statically and dynamically supporting display 125 and lid chassis antenna housing 121 together with antenna 110 during opening and closing actions of lid 100 such as illustrated by double-sided arrow in FIG. 5.

Figure 2B:
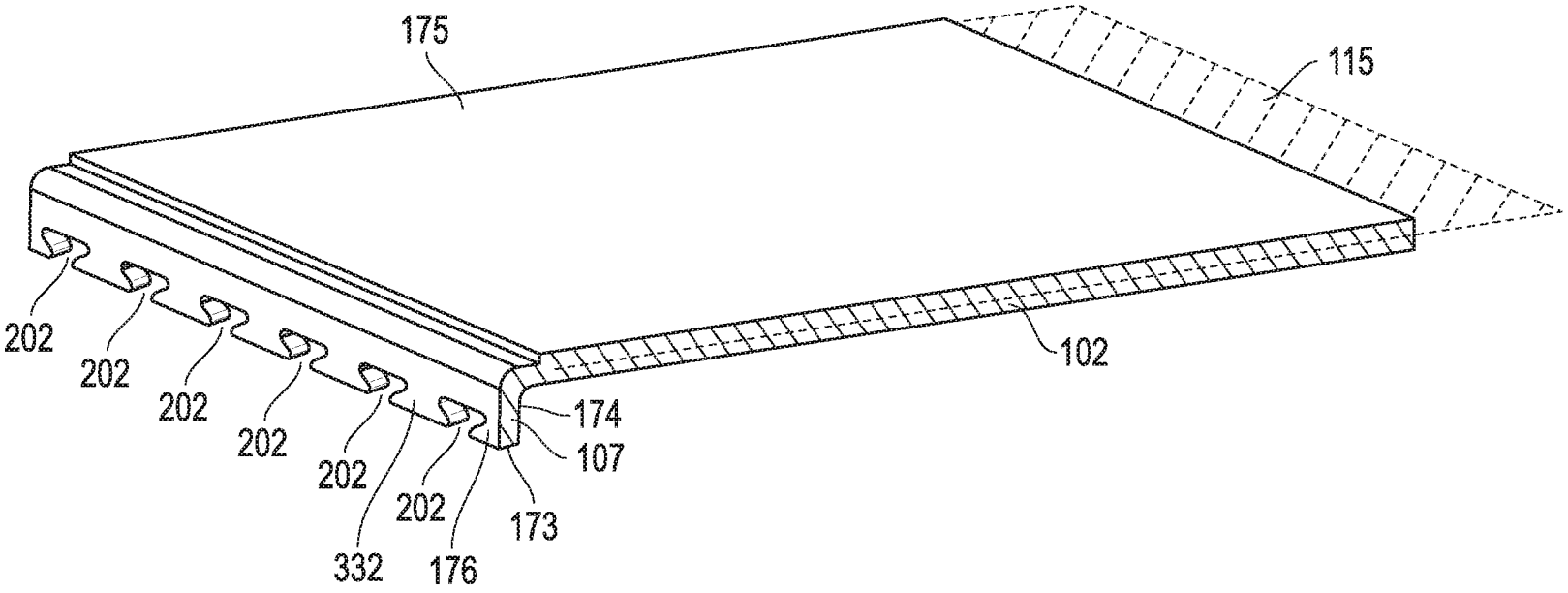
FIG. 2B illustrates a perspective cut-away view of a lid main chassis component according to one exemplary embodiment of the disclosed systems and methods.
Figure 2C:
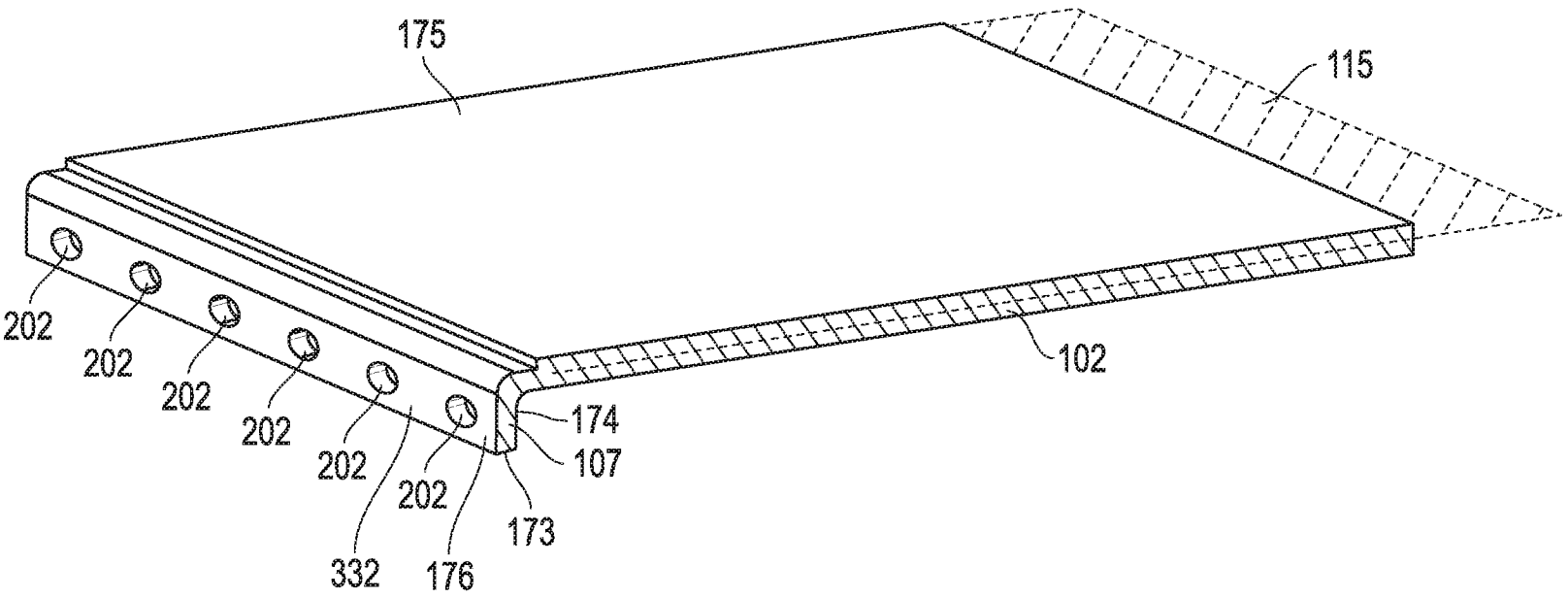
FIG. 2C illustrates a perspective cut-away view of a lid main chassis component according to one exemplary embodiment of the disclosed systems and methods.

In one exemplary embodiment illustrated in FIG. 2B, carbon fiber interlocking rib 107 may be provided with one or more optional interlocking features 202 that are defined as openings that extend through interlocking rib 107 from front surface 176 to back surface 174 of interlocking rib 107. In this exemplary embodiment, interlocking features 202 are configured to interlock with substantially non-electrically conductive material plastic resin 104 of lid chassis antenna housing 121 during manufacture (e.g., plastic resin 104 flows through openings 202 during overmolding or other fabrication process) to provide a strengthened interlocking fit, e.g., by virtue of plastic resin 104 flowing and filling interlocking features 202 in a manner that traps the plastic resin 104 within the opening area of the interlocking features 202. It will be understood that the illustrated shape of interlocking features 202 is exemplary only, and that other shapes are possible, e.g., such as semi-circular, semi-oval, semi-rectangular or semi square, etc. Moreover, although illustrated as being contiguous with the terminal edge 173 of interlocking rib 107 (e.g., as recesses in the terminal edge 173), it will be understood that interlocking features 202 may be alternatively formed as openings extending through interlocking rib 107 that are not contiguous with edge 173, but rather as openings (e.g., as circular openings, square openings, rectangular openings, irregular openings, etc.) having a location within rib 107 that are displaced apart or away from terminal edge 173 and thus surrounded on all sides by carbon fiber material of interlocking rib 107 such as illustrated in FIG. 2C.

In the illustrated exemplary embodiment of FIG. 2A, each of mating ribs 107 and 109 extend for a given distance at about a 90 degree angle relative to the major plane 115 of chassis component 102, although ribs 107 and/or 109 may be oriented at different angles relative to each other and may extend at any other angle (e.g., obtuse or acute angle) and/or length relative to thickness of lid main chassis component 102 and lid chassis antenna housing 121 that is suitable for anchoring or otherwise securely attaching lid chassis antenna housing 121 to lid main chassis component 102, e.g., such that lid main chassis component 102 statically and dynamically supports display 125 and lid chassis antenna housing 121 together with antenna 110 during opening and closing actions of lid 100 such as illustrated in FIG. 5. In one exemplary embodiment, mating rib 107 may have a rib axis 119 that extends at an angle of from about 45 degrees to about 135 degrees relative to the major plane 115 of chassis component 102, alternatively at an angle of from about 70 degrees to about 110 degrees relative to the major plane 115 of chassis component 102, alternatively at an angle of from about 80 degrees to about 100 degrees relative to the major plane 115 of chassis component 102, alternatively at an angle of from about 85 degrees to about 105 degrees relative to the major plane 115 of chassis component 102, and further alternatively at an angle of from about 85 degrees to about 90 degrees relative to the major plane 115 of chassis component 102.

Similarly, thickness of each of mating ribs 107 and/or 109 relative to thickness of lid main chassis component 102 and lid chassis antenna housing 121 may be any suitable thickness that is suitable for anchoring or otherwise securely attaching lid chassis antenna housing 121 to lid main chassis component 102 under both static and dynamic conditions. As further shown in FIG. 2A, a cut out section 179 may be provided within carbon fiber composite lid main chassis component 102 at the location of interlocking rib 107 as shown for purposes of receiving an extension segment 181 of chassis antenna housing 121 in a manner that minimizes wall thickness (e.g., Z-stack wall thickness) as compared to a conventional overlap joint and, one embodiment allows the combined thickness ("I") of chassis antenna housing 104 and thickness ("E"−"I") of lid main chassis component 102 at the area of cut out section 179 to be substantially equal to the thickness ("E") of the non-cut out (main area) area of lid main chassis component 102.

Thus, it will be understood that the particular features and/or dimensions of a lid main chassis component and attached lid chassis antenna housing may vary based on the characteristics of a particular application and anticipated stresses on these components during user operation. In one exemplary embodiment of FIG. 2A, plastic lid chassis antenna housing 104 may be configured to have a wall thickness "D" of about 1.2 millimeter and carbon fiber composite lid main chassis component 102 may be configured to have a wall thickness "E" of about 1.1 millimeter; carbon fiber composite interlocking rib 107 may be configured to have a wall thickness "F" of about 1.1 millimeter, a length "S" of about 3.5 millimeters and may be angled downward by about 85 degrees with respect to the major plane 115 of lid main chassis component 102; while plastic outer support rib 109 may be configured to have outer walls that taper inwardly by about 1.5 degrees to a terminal end thickness "H" of about 2.2 millimeters to yield an antenna window 117 having a length "C" of about 19 millimeters.

Further, cut out section 179 (and complementary extension segment 181) may be defined to a depth "I" of about 0.4 millimeters within carbon fiber composite lid main chassis component 102 at the location of interlocking rib 107, and outer support rib 109 may surround a terminal or distal end of interlocking rib 107 by a distance "J" of about 0.6 millimeter. In a further exemplary embodiment, the above dimensions and angles for configurations of lid main chassis component and attached lid chassis antenna housing may be implemented with a portable information handling system lid 100 having a thickness "B" (front display side to back side) of about 5.3 millimeters. It will be understood that each of the foregoing dimensions and angles are exemplary only and that each of the given millimeter dimensions and/or angles may be more or less than the values given herein as needed or desired to fit the characteristics of a given portable information system configuration. For example, carbon fiber composite interlocking rib 107 may be oriented substantially perpendicular (about 90 degrees) with respect to the major plane 115 of lid main chassis component 102.

In one embodiment, the ratio of the length of lid chassis antenna housing 121 to the thickness of lid main chassis component 102 may be about 17:1. In another exemplary embodiment, the ratio of the length of lid chassis antenna housing 121 to the thickness of lid main chassis component 102 may be from about 14:1 to about 20:1, and in another exemplary embodiment may be from about 15:1 to about 19:1, and in another exemplary embodiment may be from about 16.1 to about 18:1. It will be understood that these ratios are exemplary only and that greater or lesser ratios are also possible, e.g., greater than about 20:1 and less than about 14:1.

Figure 3:
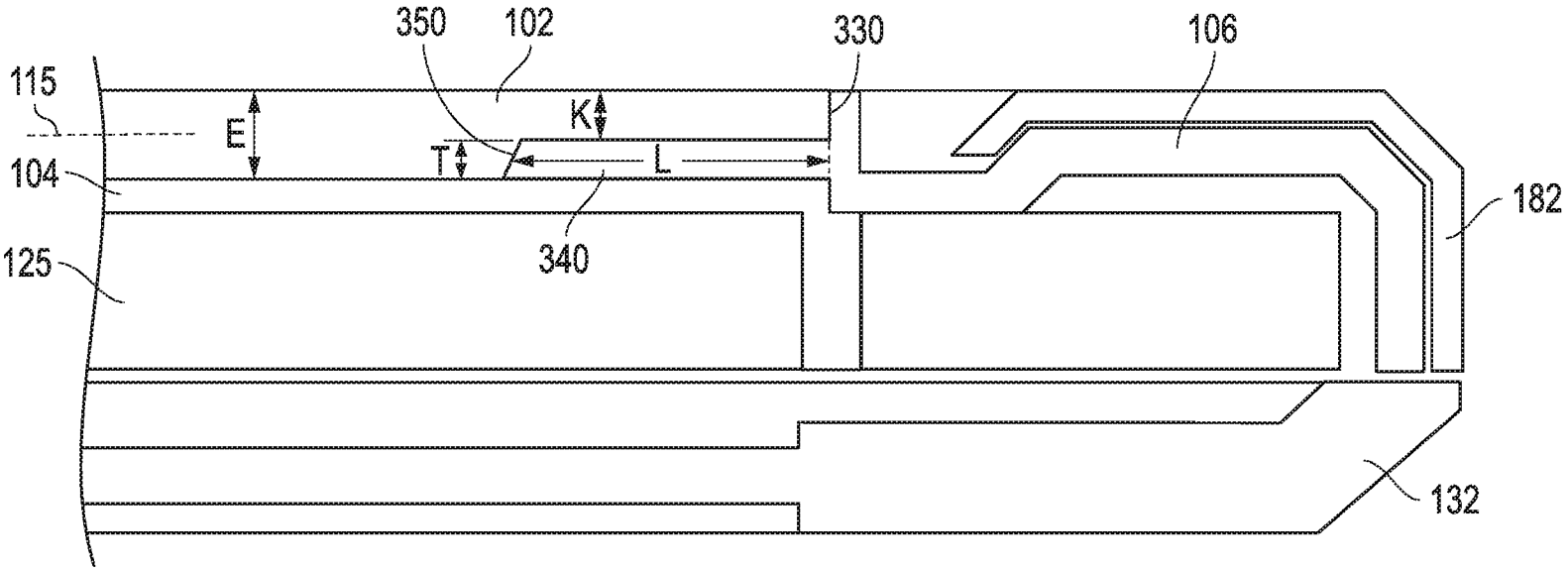
FIG. 3 illustrates a partial side cross sectional view of a portable information handling system lid according to one exemplary embodiment of the disclosed systems and methods.

FIG. 3 illustrates a partial side cross sectional view of a bottom portion of a portable information handling system lid 100 hingeably coupled to a chassis base 132 of the portable information handling system. As shown in FIG. 3, a section of the terminal edge of second end (e.g., bottom end) 330 of carbon fiber composite lid main chassis component 102 may notched, grooved or otherwise cut-away (e.g., by machining) to provide a wall thickness reduction that results in creation of a space for a mating layer segment 340 of substantially non-electrically conductive material 106 (e.g., such as plastic resin) of a lid bottom component to extend beneath the second end 330 of carbon fiber composite lid main chassis component 102 in a direction parallel to the major plane 115 of carbon fiber composite lid main chassis component 102 so as to provide space for non-electrically conductive material 106 to interlock with carbon fiber composite lid main chassis component 102 in this overlapping/underlapping area as shown to support the main chassis lid component 102 from the lid bottom component in extended cantilevered relationship to the lid bottom component. In this embodiment, underlapping layer 340 may be confined to the cut-away area of reduced wall thickness in carbon fiber composite lid main chassis component 102 such that overall thickness of layer 340 and carbon fiber composite lid main chassis component 102 is the same as the full (non-cut away) wall thickness of carbon fiber composite lid main chassis component 102 in other areas of the lid 100. This means that an underlapping interlocking joint may be created by layer 340 to join carbon fiber composite lid main chassis component 102 to non-electrically conductive material 106 without increasing the wall thickness and/or outer dimensional profile of lid 100.

For example, in one exemplary embodiment having a carbon fiber composite lid main chassis component 102 with a thickness "E" of about 1.1 millimeter, a layer 340 having a thickness "T" of about 0.4 millimeters and length "L" of about 4 millimeters may be defined within a notch space of carbon fiber composite lid main chassis component 102, leaving carbon fiber composite lid main chassis component 102 with a thickness "K" of about 0.7 millimeters adjacent its second end 330. Thus, the total thickness ("T"+"K") in the overlapping/underlapping area does not exceed the full wall thickness "E" of carbon fiber composite lid main chassis component 102. As shown, an optional tapered edge 350 may be defined on the edge of layer 340 for purposes of smooth transition. As before, each of the foregoing dimensions and angles are exemplary only each of the given dimensions and/or angles may be more or less as needed or desired to fit the characteristics of a given portable information system configuration. As with the embodiments of FIGS. 2A-2C, the embodiments of FIG. 3 is not limited to lids components of a portable information handling system, but may alternatively be employed for other configurations of portable information handling systems, such as for non-lid chassis components of a tablet computer, smart phone, etc.

Figure 4:
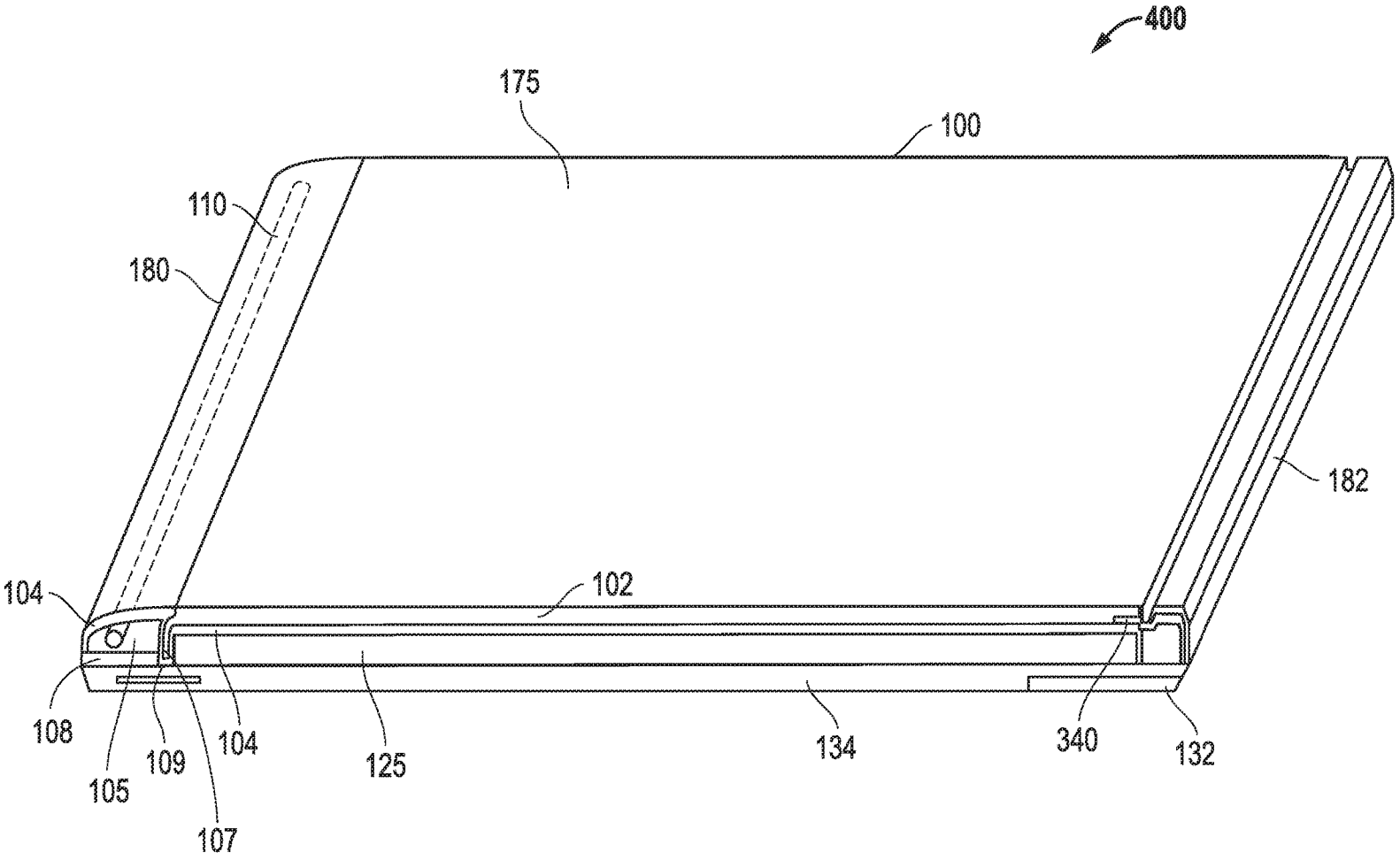
FIG. 4 illustrates a perspective cut-away view of a portable information handling system according to one exemplary embodiment of the disclosed systems and methods.

FIG. 4 illustrates a perspective cross sectional view of portable information handling 400, showing lid 100 hingeably coupled to a chassis base 132 of the portable information handling system. FIG. 5 illustrates another perspective cross sectional view of the portable information handling 400 of FIG. 4, showing lid 100 partially opened along a hinge line to reveal keyboard and I/O area 145.

Figure 6:
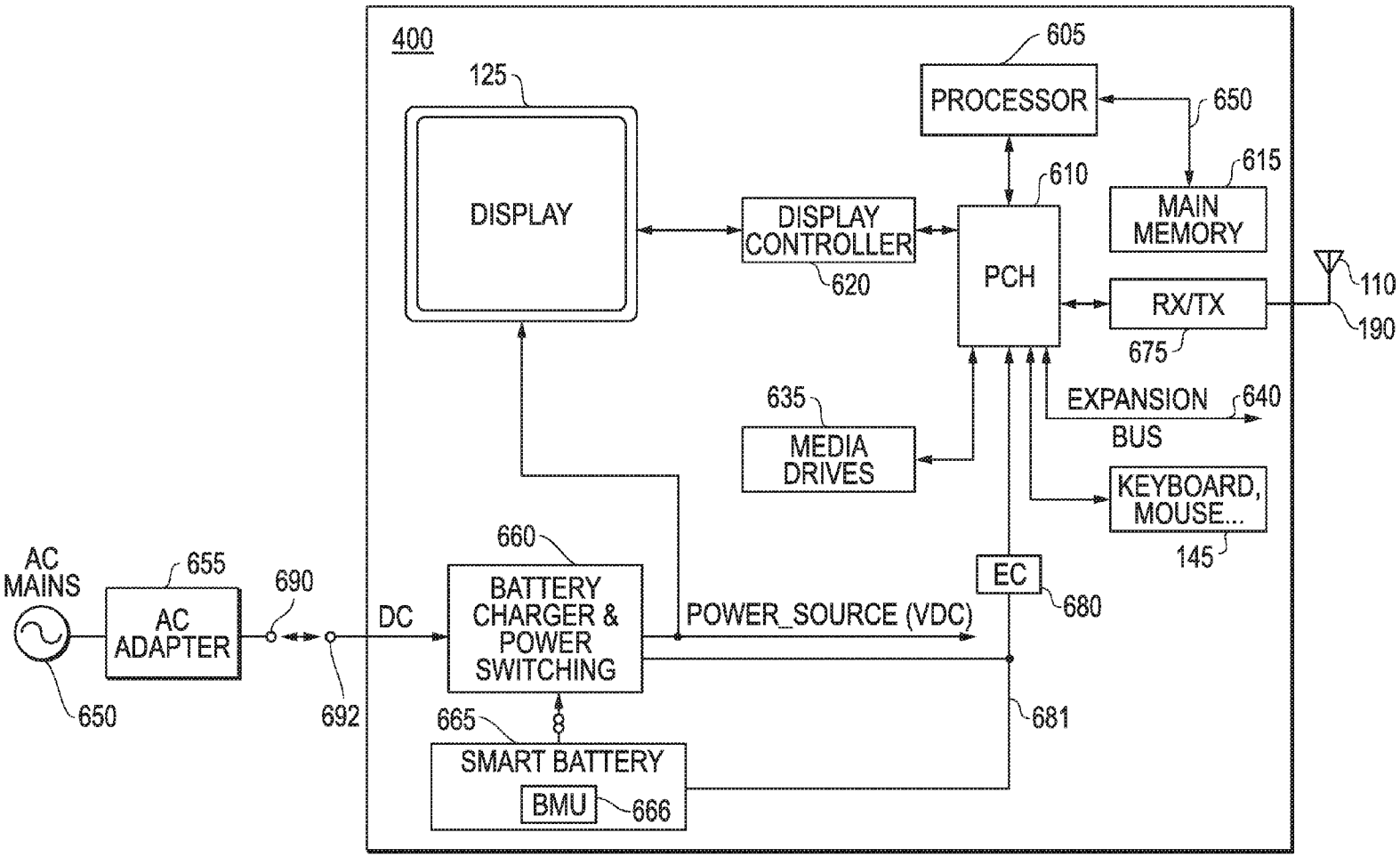
FIG. 6 is a block diagram illustrating an information handling system according to one exemplary embodiment of the disclosed systems and methods.

FIG. 6 is a block diagram of a battery powered portable information handling system 400 (e.g., such as laptop, notebook, subnotebook system such as netbook and ultrabook computer, etc.) as it may be configured according to one exemplary embodiment of the disclosed systems and methods. As shown in FIG. 6, information handling system 400 of this exemplary embodiment includes at least one processing device 605 which may be a central processing unit (CPU) such as an Intel Pentium series processor, an Advanced Micro Devices (AMD) processor or other processing device. In the particular illustrated embodiment of FIG. 6, processing device 605 may be a CPU that executes an operating system (OS) for system 400. System 400 also includes wireless transceiver circuitry 675 that is coupled to transmit and receive wireless signals (e.g., 802.11a/b/g/n wireless LAN signals or other wireless communication signals such as Bluetooth signals, cellular signals like 3G or LTE, etc.) via conductive antenna lead 190 and antenna element 110. As shown wireless transceiver circuitry 675 is communicatively coupled to processing device 605 by platform controller hub (PCH) 610.

Still referring to the exemplary embodiment of FIG. 6, CPU 605 may be provided in one embodiment with an integrated memory controller (iMC) to facilitate memory functions, although it will be understood that a memory controller may be alternatively provided as a separate chip or other circuit in other embodiments. Main system memory 615 may be coupled via DDR channel 650 as shown to CPU 605. Display 125 (e.g., LCD display or other suitable display device) is coupled to display controller 120 to provide visual images (e.g., via graphical user interface) to the user. Display controller 120 is in turn coupled to processing device 605 via PCH 610 which facilitates input/output functions for the information handling system 400. Display controller may alternatively be located in the processor chip, e.g., such as mobile architectures. Local system storage 635 (e.g., one or media drives such as hard disk drive/s, optical drives, NVRAM, Flash or any other suitable form of internal or external storage) may be coupled to PCH 610 and its controller chip to provide permanent storage for the information handling system 400. Input devices 145 (e.g., such as a keyboard, mouse, touchpad, touchscreen, etc.) may be coupled as shown to PCH 610 and its controller chip to enable the user to interact with the information handling system 400 and programs or other software/firmware executing thereon. An expansion bus 640 may be coupled to PCH 610 to provide the information handling system 400 with additional plug-in functionality. Expansion bus 640 may be, for example, a PCI bus, PCI Express bus, SATA bus, USB or any other suitable expansion bus. An embedded controller (EC) 680 running system BIOS may also be coupled to PCH 610 as shown.

As shown, information handling system 400 is coupled to a source of system power, namely AC mains 650 and AC adapter 655, and includes a battery pack 665. As shown in FIG. 6, AC adapter 655 is removable from battery charger and power switching circuitry 660 of information handling system 400 at mating interconnection terminals 690 and 692 such that information handling system 400 may be powered from batteries of battery pack 665 alone. AC adapter may also be optionally and temporarily coupled at terminals 690 and 692 to battery charger and power switching circuitry 660 in order to provide information handling system 400 with a source of system power as an alternative and/or in addition to power provided by smart battery pack 665, e.g., lithium ion ("Li-ion"), nickel metal hydride ("NiMH"), nickel cadmium (NiCd), or lithium-polymer (Li-polymer) battery pack including one or more rechargeable batteries and a BMU that includes an analog front end ("AFE") and microcontroller. Further, a battery system data bus (SMBus) 681 may be coupled to smart battery pack 665 to provide battery state information, such as battery voltage, current and charge level information, from BMU 666 of smart battery pack 665 to embedded controller 680. Battery charger and power switching circuitry 660 of information handling system 400 may also provide DC power for recharging battery cells of the battery system 665 during charging operations.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network storage device, or any other suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communications between the various hardware components.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed systems and methods may be utilized in various combinations and/or independently. Thus the invention is not limited to only those combinations shown herein, but rather may include other combinations.

What is claimed is:

1. A portable information handling system, comprising:

a non-electrically conductive chassis component of a portable information handling system, the non-electrically conductive chassis component including a first elongated rib; and a separate electrically conductive chassis component of the portable information handling system, the electrically conductive chassis component including a second elongated rib formed thereon;

where the first elongated rib and second elongated rib are coupled together in interlocking mated relationship to support the non-electrically conductive chassis component from the electrically conductive chassis component.

2. The system of claim 1, where the non-electrically conductive chassis component comprises plastic resin.

3. The system of claim 1, where the non-electrically conductive chassis component has an antenna cavity defined therein; and where the system further comprises an antenna element disposed within the antenna cavity.

4. The system of claim 3, where a distance between a first end and a second end of the non-electrically conductive chassis component defines a length of the antenna housing; and where the antenna cavity is defined within the non-electrically conductive chassis component across a width of the antenna housing.

5. The system of claim 1, where the second elongated rib of the electrically conductive chassis component has a rib axis that extends at an angle relative to a major plane of the electrically conductive chassis component; and where the second elongated rib is received and trapped within the first elongated rib of the non-electrically conductive chassis component in an interlocking mated relationship.

6. The system of claim 1, where the second elongated rib has a front surface and a back surface; where one or more interlocking features are defined as openings that extend through the second elongated rib from the front surface to the back surface of the second elongated rib; where the second elongated rib is received and trapped within the first elongated rib of the non-electrically conductive chassis component in an interlocking mated relationship; and where a material of the first elongated rib is disposed and trapped within the openings of the interlocking features of the second elongated rib.

7. The system of claim 1, further comprising a chassis lid hingeably coupled to a chassis base at a hinge line; where the chassis lid comprises the electrically conductive chassis component and the non-electrically conductive chassis component; and where the electrically conductive chassis component has a second end that is opposite from a first end of the electrically conductive chassis component and is disposed between the first end of the electrically conductive chassis component and the hinge line.

8. The system of claim 7, where the chassis lid further comprises a lid bottom component coupled to the second end of the electrically conductive chassis component; where the electrically conductive chassis component has a first thickness; where a portion of a terminal edge of the second end of the electrically conductive chassis component has a second wall thickness that is less than the first thickness and is coupled to a mating layer segment of the lid bottom component to support the electrically conductive chassis component from the lid bottom component in extended relationship to the lid bottom component; and where the combined coupled thickness of the mating layer segment of the lid bottom component and the second thickness of the terminal portion of the electrically conductive chassis component is substantially equal to and aligned with the first thickness of the electrically conductive chassis component.

9. The system of claim 7, where the distance between the second end of the non-electrically conductive chassis component to the hinge line between the chassis lid and chassis base defines a length of the lid; and where an antenna cavity is defined within the non-electrically conductive chassis across a width of the chassis lid between the first and second ends of the non-electrically conductive chassis component, the system further comprising an antenna element disposed within the antenna cavity.

10. The system of claim 1, where the electrically conductive chassis component has a first thickness; where a cut out section is defined within the electrically conductive chassis component at a first end of the electrically conductive chassis component such that the electrically conductive chassis component has a second reduced thickness that is less than the first thickness; where the second elongated rib is formed on the first end of the electrically conductive chassis component; where the non-electrically conductive chassis component comprises an extension segment that is formed on a first end of the non-electrically conductive chassis component received within the cut out section of the electrically conductive chassis component; and where the combined coupled thickness of the non-electrically conductive chassis component extension segment and the second reduced thickness of non-electrically conductive chassis component is substantially equal to the first thickness of the electrically conductive chassis component.

11. The system of claim 1, where the first elongated rib and second elongated rib are coupled together in interlocking mated relationship to support the non-electrically conductive chassis component from the electrically conductive chassis component in extended relationship to the electrically conductive chassis component.

12. A portable information handling system, comprising:

an electrically conductive chassis component of a portable information handling system; and a separate second chassis component of the portable information handling system coupled to the electrically conductive chassis component;

where the electrically conductive chassis component has a first thickness; where a portion of a terminal edge of the electrically conductive chassis component has a second wall thickness that is less than the first thickness and is coupled to a mating layer segment of the second chassis component; and where the combined coupled thickness of the mating layer segment of the second chassis component and the second thickness of the terminal portion of the electrically conductive chassis component is substantially equal to and aligned with the first thickness of the electrically conductive chassis component.

13. The system of claim 12, further comprising a chassis lid hingeably coupled to a chassis base at a hinge line; where the chassis lid comprises the electrically conductive chassis component and the second chassis component; and where the second chassis component is disposed between the terminal edge of the electrically conductive chassis component and the hinge line; and where the terminal edge of the electrically conductive chassis component is coupled to the mating layer segment of the second chassis component to support the electrically conductive chassis component from the second chassis component in extended relationship to the bottom component.

14. The system of claim 12, where the bottom component comprises plastic resin.

15. A method of supporting a chassis component for a portable information handling system, comprising:

providing a non-electrically conductive chassis component of a portable information handling system, the non-electrically conductive chassis component including a first elongated rib;

providing a separate electrically conductive chassis component of the portable information handling system, the electrically conductive chassis component including a second elongated rib formed thereon; and coupling the first elongated rib and second elongated rib together in interlocking mated relationship to support the non-electrically conductive chassis component from the electrically conductive chassis component.

16. The method of claim 15, where the non-electrically conductive chassis component has an antenna cavity defined therein; and where the method further comprises providing an antenna element disposed within the antenna cavity.

17. The method of claim 15, where the second elongated rib has a front surface and a back surface; where one or more interlocking features are defined as openings that extend through the second elongated rib from the front surface to the back surface of the second elongated rib; and where the method further comprises coupling the first elongated rib and second elongated rib together so that the second elongated rib is received and trapped within the first elongated rib of the non-electrically conductive chassis component in an interlocking mated relationship and such that a material of the first elongated rib is disposed and trapped within the openings of the interlocking features of the second elongated rib.

18. The method of claim 15, where the electrically conductive chassis component has a second end that is opposite from a first end of the electrically conductive chassis component; and where the method further comprises:

coupling the electrically conductive chassis component and the non-electrically conductive chassis component together as a chassis lid; and hingeably coupling the chassis lid to a chassis base at a hinge line with a second end of the electrically conductive chassis component that is opposite from the first end of the electrically conductive chassis component and is disposed between the first end of the electrically conductive chassis component and the hinge line.

19. The method of claim 18, where the chassis lid further comprises a lid bottom component having a mating layer segment; where the electrically conductive chassis component has a first thickness; where a portion of a terminal edge of the second end of the electrically conductive-chassis component has a second wall thickness that is less than the first thickness; and where the method further comprises:

coupling the portion of the terminal edge of the second end of the electrically conductive chassis component to the mating layer segment of the lid bottom component to support the electrically conductive chassis component from the lid bottom component in extended relationship to the lid bottom component such that the combined coupled thickness of the mating layer segment of the lid bottom component and the second thickness of the terminal portion of the electrically conductive chassis component is substantially equal to and aligned with the first thickness of the electrically conductive chassis component.

20. The method of claim 15, where the electrically conductive chassis component has a first thickness; where a cut out section is defined within the electrically conductive chassis component at a first end of the electrically conductive chassis component such that the electrically conductive chassis component has a second reduced thickness that is less than the first thickness; where the second elongated rib is formed on the first end of the electrically conductive chassis component; where the non-electrically conductive chassis component comprises an extension segment that is formed on a first end of the non-electrically conductive chassis component received within the cut out section of the electrically conductive chassis component; and where the combined coupled thickness of the non-electrically conductive chassis component extension segment and the second reduced thickness of non-electrically conductive chassis component is substantially equal to the first thickness of the electrically conductive chassis component.

21. The method of claim 15, further comprising coupling the first elongated rib and second elongated rib together in interlocking mated relationship to support the non-electrically conductive chassis component from the electrically conductive chassis component in extended relationship to the electrically conductive chassis component.

* * * * *